US007028623B1

(12) United States Patent
Pearson

(10) Patent No.: US 7,028,623 B1
(45) Date of Patent: Apr. 18, 2006

(54) TREATMENT OF CARBONACEOUS MATERIAL

(76) Inventor: Frederick Pearson, 7 Victoria House Weston Road, Bath, BA1 2XY (GB)

( * ) Notice: Subject to any disclaimer, the term of this patent is extended or adjusted under 35 U.S.C. 154(b) by 219 days.

(21) Appl. No.: 10/088,063

(22) PCT Filed: Sep. 14, 2000

(86) PCT No.: PCT/GB00/03546

§ 371 (c)(1),
(2), (4) Date: Mar. 13, 2002

(87) PCT Pub. No.: WO01/20228

PCT Pub. Date: Mar. 22, 2001

(30) Foreign Application Priority Data

Sep. 14, 1999 (GB) ..... 9921520

(51) Int. Cl.
*F23B 7/00* (2006.01)
*F23G 1/00* (2006.01)

(52) U.S. Cl. ..... 110/341; 110/229; 110/194

(58) Field of Classification Search ..... 110/229, 110/230, 242, 250, 194, 101 CC, 241, 341
See application file for complete search history.

(56) References Cited

U.S. PATENT DOCUMENTS 4,781,174 A * 11/1988 Gardner ..... 126/681
4,823,711 A * 4/1989 Kroneberger et al. ..... 110/236
4,879,789 A * 11/1989 Bak ..... 27/11
4,934,286 A * 6/1990 Fowler ..... 110/346
4,937,411 A * 6/1990 Suzuki et al. ..... 219/679
5,207,176 A * 5/1993 Morhard et al. ..... 110/246
5,237,938 A * 8/1993 Fujimori et al. ..... 110/240
5,397,551 A 3/1995 Won Sam
5,886,326 A * 3/1999 Tang ..... 219/679

FOREIGN PATENT DOCUMENTS

EP 0 318 598 A 6/1989
GB 2 032 596 A 5/1980

* cited by examiner

*Primary Examiner*—Kenneth Rinehart
(74) *Attorney, Agent, or Firm*—Gifford, Krass, Groh, Sprinkle, Anderson & Citkowski, P.C.

(57) ABSTRACT

A process for the treatment of organic matter, comprises the steps of preliminary microwave irradiation in an oxygen-depleted atmosphere to give a black ash-like residue, followed by combustion of the residue to give a white ash. Hence the emissions of carcinogens such as dioxins are substantially reduced as are heavy metals such as Mercury and Cadimum. The apparatus (11) comprises a single chamber (12) in which both steps of the process are performed. The apparatus (11) also comprises means for generating nitrogen- or oxygen-depleted air as well as scrubbers (2), filters, condensers and the like for treating the gaseous products (carbon dioxide and steam) of the process. The apparatus (11) may be of a portable and modular nature—and may optionally include a cremulator.

35 Claims, 7 Drawing Sheets

TREATMENT OF CARBONACEOUS MATERIAL

The present invention is generally directed towards improvements in the treatment of carbonaceous material. The present invention is concerned with a process and apparatus therefor, for the treatment of carbonaceous material, including organic matter, and is particularly, although not exclusively, directed towards improvements in the disposal of human and/or animal remains by cremation.

The disposal of carbonaceous material has conventionally been conducted by combustion in purpose-built furnaces. Such incineration has, until recently, been the method of choice for the disposal of a wide variety of carbonaceous matter including plant materials, synthetic materials such as motor vehicle tires, medical waste, as well as human or animal remains.

Although originally thought to offer an efficient and relatively clean process, the consequences of incineration of carbon based materials have become increasingly apparent. It is now evident that significant and harmful emissions of toxic compounds occur during incineration and that the compounds released include potent polychlorinated carcinogens such as dioxins and the related dibenzofurans. A number of studies have linked levels of such compounds, which persist in the environment and steadily accumulate in the food chain, to increased incidences of a wide range of cancers including lung and testicular cancers.

For example, the disposal of the human body by ordinary cremation results in the emission of a variety of harmful compounds including highly toxic, non-biodegradable dioxins that steadily accumulate in the environment.

Hospital incinerators, household waste incinerators and crematoria, have all been identified as significant contributors to such pollution and, as a result of recent legislation and the threat of future legislation, are increasingly under pressure to control their emissions.

The present invention starts from the realisation that harmful emissions are primarily caused by the high temperatures of ordinary, oxidative combustion processes.

The degradation of carbonaceous material including organic matter, has therefore become a subject of much investigation with some recent developments focusing on ways of achieving thermal degradation (pyrolysis) of the material without incineration. Several such methods are known to involve the absorption of electro-magnetic energy in the form of microwave, infra-red and radio-frequency radiation so as to cause pyrolysis. For example, U.S. Pat. No. 5,886,326 discloses a method and apparatus for incinerating garbage by preliminary microwave irradiation in vacuo, introduction of oxygen and continued irradiation to cause combustion. The method uses a silicon shroud that is heated to a temperature of 500 to 1000° C. by the absorption of energy whereby to ignite the material to be disposed of. The document suggests that the method and apparatus may be used for cremation but is silent as to how exactly this may be satisfactorily achieved according to standard conventions of humane and decent disposal.

Briefly stated, the absorption of energy into the organic material by microwave irradiation for example, causes the fission of the molecular bonds comprising the material in a process resembling the absorption of thermal energy. The process, which is conducted in an oxygen deficient environment to prevent possible spontaneous combustion, does not therefore lead to the high temperatures caused by a combustion process nor to the products of uncontrolled recombination of the constituent atoms of the material with oxygen. Put another way, chemical reactions resulting from degradation of the material occur in a "reducing" environment rather than the "oxidising" environment of combustion. Consequently the formation of compounds of the toxic nature of the oxygen-containing dioxins and furans is largely avoided and other harmful emissions are also significantly reduced.

The use of microwave irradiation for degradative pyrolysis of organic matter has hitherto been directed to the reduction of tires, household or medical waste and the like. One such process, the so called Emery Process, first described for the reduction of tires and medical waste, has been adapted for commercial use as a medical or biomedical waste reduction system. The method, commercially known as "reverse polymerisation", comprises the use of a housing arrangement in which there are located a number of chambers for the treatment of the waste material. A continuous feed introduces the waste material into a first compartment whilst the atmosphere within the housing is purged of oxygen. The material is then fed into a second chamber where it is irradiated with microwave radiation generated by an array of transducers. After irradiation the degraded material is fed into a third compartment where it is allowed to cool and is then collected as a sterile ash-like carbon residue. The gaseous by-products of the fission of the material, which are mostly water in the form of steam and carbon dioxide are also collected by means of trapping either by condensation or by reaction with sodium hydroxide solution. The residue of the process is generally not further treated and is disposed of in land-fill.

The prior art also includes WO 89/04355 A1 which discloses a similar method for the treatment of carbonaceous matter (Holland Process) describing the preliminary step of heating tire waste to a temperature of at least 250° C. before microwave irradiation. The heating means is substantially effected by recycling of the gaseous products of the previous degradation from the microwave irradiation zone within a housing to a preheating zone within the same housing.

Under certain circumstances the treatment of carbonaceous material by microwave irradiation, with or without preliminary heating, may not proceed to an acceptable level of completion.

According to the present invention therefore, there is provided a process for the treatment of carbonaceous material comprising the steps of:

i) introducing the material, into a chamber having closure means, ii) extracting or displacing oxygen from the chamber so as to provide a substantially oxygen-depleted atmosphere, iii) effecting a preliminary treatment of the material by irradiating with electromagnetic radiation of sufficient power and for a sufficient period to cause substantial degradation of the carbonaceous material to an ash-like residue;

(iv) introducing oxygen and air and at least one combustible gas into the said chamber, and (v) igniting said at least one combustible gas whereby to cause combustion and reduce the residue from the irradiation step to a fine ash.

The present invention thus not only provides for a further reduction in volume of the processed material compared to microwave irradiation alone, but also allows for the possibility of varying the extent of irradiation so that susceptible matter is degraded and less susceptible matter is incinerated. Thus disposal may be optimised and extraneous matter may be tolerated. One circumstance in which such considerations may arise is in the treatment of human or animal remains.

It will be understood that neither of the prior art processes discussed above could be directed toward the treatment of human or animal remains without significant adaptation to fulfil strict legal conditions that such remains must be disposed of by a process involving combustion.

Step v) may exclude the continuance of electromagnetic irradiation; that is, the irradiation and combustion steps may be temporally separated and/or mutually exclusive.

Step iv) may be performed by removing the residue obtained by step ii) from the said chamber to a second chamber, equipped with means for introducing air or oxygen and containing heating means which may include introduction and combustion of combustible gas.

The ignition of the combustible gas may be achieved by any known means, for example it may be initiated by further irradiation with electromagnetic radiation.

Step ii) may be performed by introducing an inert gas or oxygen-depleted air into the at least one chamber whereby substantially to fill it.

In preferred embodiments of the invention step iii) is performed by irradiating the material with microwave radiation. Preferably the process includes the further step of weighing the material to be treated so as to determine the energy level and/or time for which irradiation should be continued in order to achieve the desired result. Preferably the weighing step occurs before step iii). Alternatively the weighing step may occur during step iii) so as continuously to relate the material remaining with the energy level and/or time of irradiation required to achieve the desired level of degradation.

The process of the present invention may also include the further step of cooling the solid products of step v) before collection. In another embodiment of the invention the process may further include the step of trapping the gaseous products of step iii) and/or step v). The trapping means may involve chemical or physical transformation of the effluent gases. The process may further comprise the step of delivering the collected products to a delivery point.

In a preferred embodiment of the present invention, for example in the treatment of a coffin and body, the process may also comprise a further step whereby the carbonaceous material is pre-heated prior to the irradiation. The pre-heating step serves to prevent the development of a pressure gradient during the initial stages of the irradiation, in particular allowing means by which the coffin seal may be broken.

It will be understood that the process of the present invention leads to a white ash of substantially reduced volume than the black residue obtained by processes involving irradiation without combustion.

In arriving at a further embodiment of the present invention, Applicant has identified and solved a number of problems not apparent from the teaching of U.S. Pat. No. 5,886,326. In particular, Applicant has solved the problem of irradiating a coffin and body. That problem is not addressed by the aforementioned patent and it has been found that microwave irradiation of a coffin and body leads to a pressure gradient arising in the enclosed coffin that can cause the body to explode. Such a result is clearly undesirable and, since the disposal of a human body is not like the disposal of garbage and requires the provision of a coffin, a solution must be found.

According to a further embodiment of the present invention there is provided a process for the cremation of the human or animal body comprising the introduction of a body within a coffin into a chamber having closure means, and performing thereon a process as hereinabove described.

In a preferred embodiment of the present invention the step of at least partial opening of the coffin is performed by mechanical means.

Preferably the process comprises the further step of cooling the solid products of the combustion step. Still more preferably the process comprises an additional step of collecting the solid products of the combustion step.

The process may also comprise the step of grinding the cooled solid products of the combustion step in a cremulator. The process may also comprise the step of delivering the collected products to a delivery point. The collection and delivery steps may be advantageously automated. The process of the invention, including the preferred delivery steps, may also be operated so that arrival of the collected products at the delivery point is timed to coincide with the end of a funeral service. Thus, the process of the invention contemplates a complete, "one-stop" cremation of the human body whereby the ashes of the deceased may be delivered to relatives attending the funeral service.

As explained below, the present invention also contemplates a process comprising the cremation of more than one body at the same time (albeit in separate chambers). In this embodiment the steps leading to and including irradiation may be performed at the same time. Of course, sequential irradiation steps may be performed.

The present invention further contemplates a preliminary step of providing refrigerated storage means for temporarily storing the human bodies prior to cremation.

The entire process may take place in a single chamber. This is necessary if existing cremation practices are to be maintained. It is, for example, not acceptable for human remains to be moved between different chambers for different operations. Embodiments adapted for disposal of other carbonaceous material, however, may have more than one chamber.

The present invention also provides apparatus for the treatment of carbonaceous material comprising a housing defining at least one chamber and having an opening for introducing the material into the said at least one chamber together with closure means for closing the said at least one chamber, the housing also comprising means for extracting or displacing oxygen from the said at least one chamber so as to provide a substantially oxygen-depleted atmosphere in the said at least one chamber, means for irradiating the material in the said at least one chamber with electromagnetic radiation of sufficient power and for a sufficient time so as to cause degradation of the said material to a residue, means for admitting oxygen or air and at least one combustible gas into the presence of said residue, and means for ignition of the said combustible gas within the said at least one chamber so as to cause substantial combustion and reduce the residue from the irradiation step to a fine ash.

The means for ignition may comprise irradiation with electromagnetic radiation.

In another embodiment of the invention the apparatus includes means for weighing the carbonaceous material prior to, or upon introduction of the material into the chamber.

In presently preferred embodiments of the invention the apparatus further comprises cooling means for cooling the solid products of combustion and may also comprise collecting means for collection of the solid products.

In one embodiment of the invention the apparatus also provides for the collection of the gaseous products of irradiation and/or combustion. The collection means may be condensers for the collection of water and sodium hydroxide or neutramag (trade name) or other means for the trapping of carbon dioxide.

In another embodiment of the invention the apparatus may comprise means for generating nitrogen or oxygen-depleted air. Alternatively the apparatus may include merely a store of nitrogen or oxygen-depleted air. As an alternative to nitrogen as an inert gas, helium or hydrogen may be preferred to purge the apparatus of oxygen. Helium is particularly preferred because it can be extracted using filters more quickly than the other suitable gases.

In a presently preferred embodiment of the invention the apparatus includes heating means for pre-heating the carbonaceous material prior to irradiation. The pre-heating means may also comprise means for effecting combustion of the material after irradiation. In a particularly preferred embodiment the heating means comprise infra-red hotplates. Such heating elements can quickly significantly raise the temperature within the chamber.

In another embodiment of the present invention at least one chamber is formed in a portable housing having means for connection to an external energy source. The apparatus may also be of a modular nature allowing housings to be stacked upon each other or otherwise closely arranged. The apparatus may include wheel or other rolling support means to facilitate transport. In this embodiment the housings will each contain means for irradiation and combustion of the material therein introduced but may share sources of energy, and sources of inert gas as well as trapping means for the collection of gaseous products of irradiation and combustion. Preferably, however each housing will have separate collecting means for collecting the solid products of combustion.

Filter units may be provided for treating any waste liquids or gases released during the treatment process. A preferred form of filter is an impregnated activated carbon filter. Use of such filters is possible because the temperature of waste products generated is low enough so that there is no degradation and/or possibility of combustion of the filters. Previously the high temperature vapours resulting from combustion could not be passed through such a filter and, consequently, it is not possible so easily to remove mercury vapours. The filters can be reused following removal of the contaminants. Activated carbon filters are available which treat gases and/or liquids and advantageously remove various likely components of effluent discharges including Mercury, Cadmium and Nickel. These filters are considerably cheaper than equivalents used in the prior art.

It is seen as advantageous if the maximum different types of treatable material can be treated with a minimum of alteration to the apparatus. The apparatus may therefore be formed from a plurality of units to be assembled in a modular array dependent of the required process. Units may include, for example, cryogenic, grinding, electromagnetic radiation generating, combustion and refrigeration modules.

Where the apparatus is involved with treatment of, for example, medical waste, it may be necessary to crush or grind the waste. There may be provided a cryogenic unit for waste materials to make them brittle to allow them to be crushed or ground.

The present invention also provides apparatus for the cremation of the human body comprising apparatus as hereinabove described.

Preferably the means for effecting the at least partial opening of the coffin comprise or include mechanical means. Alternatively the means for effecting the at least partial opening of the coffin may comprise or include means for heating the coffin and body.

The apparatus may also include means for cooling the solid products of the combustion. The cooling means may be liquid nitrogen cooling means.

In one embodiment of the present invention the apparatus further comprises means for the collection of the cooled products of combustion. Preferably the apparatus also includes a cremulator and means for the delivery of the collected products to a delivery point.

In a further embodiment of the present invention there may also be provided means for the temporary storage of the human body and/or the coffin prior to the cremation treatment. Preferably the storage means comprise refrigeration means for keeping the body cooled. The refrigeration means may advantageously use liquid nitrogen cooling means. Alternatively, the cooling means for cooling the ashes prior to collection may comprise a gas that can be advantageously cooled by passage through the refrigerated storage means.

The temporary storage of a body or bodies may be a desirable feature of the present invention since the apparatus is transportable and modular in nature and may include its own power means. Thus the apparatus may advantageously be used in conditions where distributed power does not exist or has failed and/or in conditions or countries where public health requirements demand the rapid disposal of human bodies.

Further, the apparatus of the present invention may provide for the contemporaneous or accelerated cremation of more than one human body by providing more than one chamber for irradiating the coffin and body with electromagnetic radiation. Preferably, each chamber may include multiple components for performing the other steps of the process of the invention. Alternatively, each chamber may be operatively linked to a common, further chamber where these steps are performed.

In one embodiment of the present invention each irradiation chamber may be provided with irradiating means comprising a single transducer or an array of transducers. In an alternative embodiment a single transducer or array of transducers may be centrally provided in the apparatus and is/are adjustable so as to direct electromagnetic radiation into one or other of the irradiation chambers.

When the electromagnetic generators are activated there may be a risk of sparking occurring within the chamber due to the presence of metals in the article being irradiated, for example teeth fillings jewellery, belt buckles and the like. To avoid this risk the chamber may be lined with mica glass panels. Mica has high insulation properties, is temperature resistant, does not absorb water and can withstand high pressures. Although only relatively small panels can currently be made, these can be connected together by interdigitating fingers in the manner of a multiple housing joint.

Various embodiments of the process and apparatus of the present invention will now be described by way of non-limiting example with reference to the following drawings in which like numerals describe like elements and in which.

Figure 1:
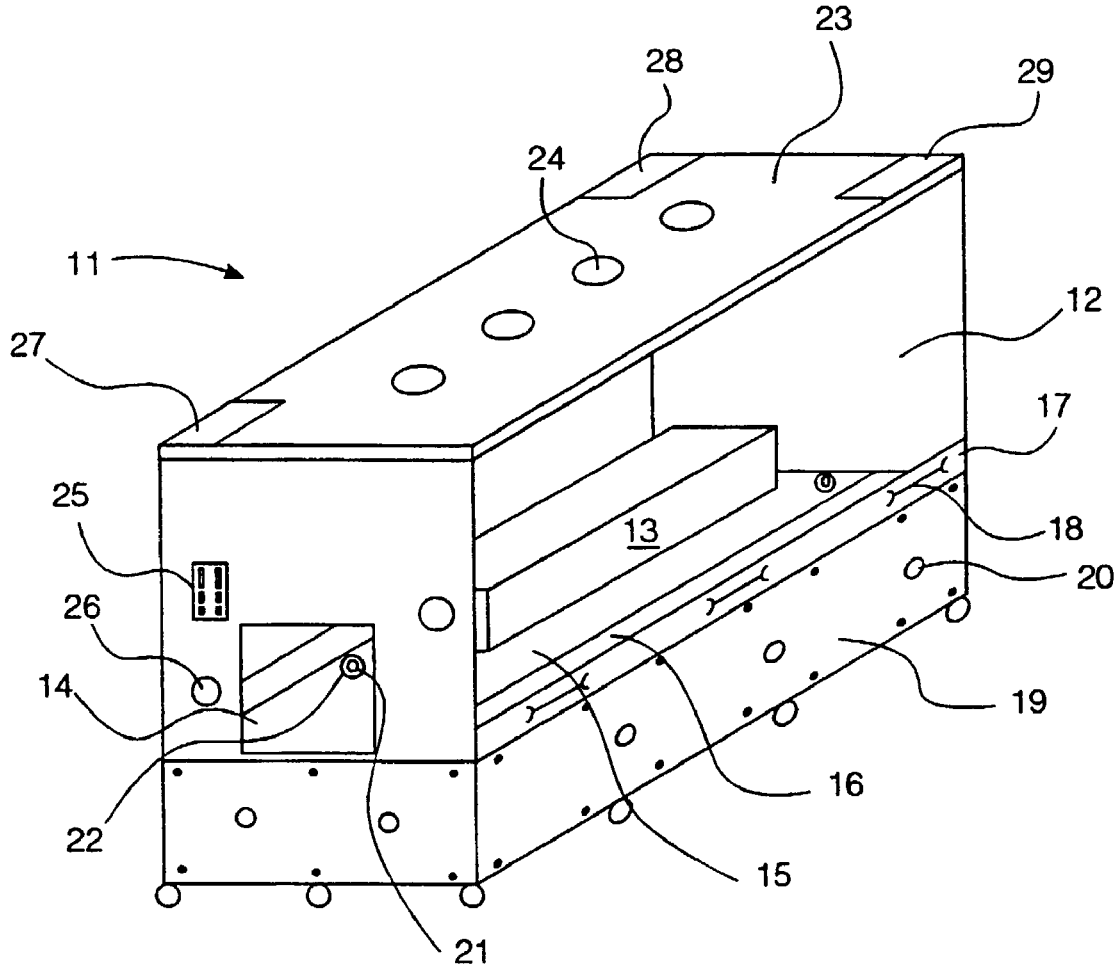
FIG. 1 is an isometric cut-away view of a first embodiment of the invention according to a first aspect.

Referring now to the drawings and particularly to FIG. 1, apparatus for performing the process of the first aspect of the invention comprises a portable housing 11 having a single chamber 12 for receipt of a coffin 13 containing a human body. The coffin 13 is introduced into the chamber via an opening 14 onto a gangway 15 formed on or in the chamber floor 16. The opening 14 is fitted with a lockable door (not shown) so as to form an airtight seal on closure. Chamber floor 16 is formed as a plate or tray with slide engagement means for sliding in and out of the housing 11. A perpendicular wall 17 formed at a single edge of the plate fits into an aperture defined in the side panelling of the housing and has there handles 18 so as to allow withdrawal of the chamber floor 16 at the end of the treatment process. Housing 11 further includes a compartment 19 arranged underneath chamber 12. Compartment 19 contains essential electrical, mechanical, computing and monitoring equipment necessary for the operation and monitoring of the treatment process. Control dials 20 are arranged in the side wall of compartment 19 for control and adjustment of the treatment process. For example, in the embodiment illustrated the compartment 19 has ignition means 21 projecting through apertures 22 in chamber floor 16. The ignition means 21 comprises spark plugs and apertures 22 serve for the introduction of a combustible gas or mixture of gases into chamber 12.

In an alternative embodiment of the invention (not shown) the compartment 19 takes the form of a drawer in the side of the housing 11 so that it may be withdrawn from the housing for access to the operating machinery. The compartment may also house a cremulator (not shown) for grinding of the ash obtained at the end of the process should it be required. In one such embodiment chamber floor 16 is not withdrawn from the housing at the end of the process but provided with a chute or similar so as allow the ash to be transferred to the cremulator.

Housing 11 further includes a roof panel 23 which can slide in and out of a channel defined in the side wall panels. Roof panel 23 includes an array of transducers 24 for irradiating the chamber with microwave radiation arranged in a honeycomb panel behind a microwave transparent glass screen (not shown). The transducers 24 are electrically connected to a transformer or generator in compartment 19 or an external power supply by connecting wires extending through the side panelling of the housing 11. Transducers 24, which may comprise magnetrons and have water-cooling means, are protected from the effects of irradiation and combustion by the glass screen, which is constructed to withstand temperatures of up to 1500° C.

The front wall of the housing, in which is located the opening 14 together with its associated door, has a control panel 25 for selecting the time and/or energy level of the treatment process by the operator. This selection may be made by reference to monitoring equipment or according to the experience of the operator. To aid in the selection of the desired time for irradiation, a spy hole 26 is provided adjacent the door so that the extent of degradation can be determined visually. Spy holes 26 may of course be provided at any convenient position in the housing 11 including within the roof panel 23 and may take the form of video cameras. Roof panel 23 further provides means for the introduction of inert gas or nitrogen gas or oxygen-depleted air into the chamber as well as exit means for the evacuation of air, purging or effluent gases. It will be appreciated that where such means are provided, as in the case of the door for opening 14 and chamber floor 16, hermetic sealing means must also be provided.

Functions under automatic and/or manual control may include locking and unlocking of doors, monitoring safety perameters such as temperature or microwave leakage and initiating shut down if these are exceeded.

Figure 2:
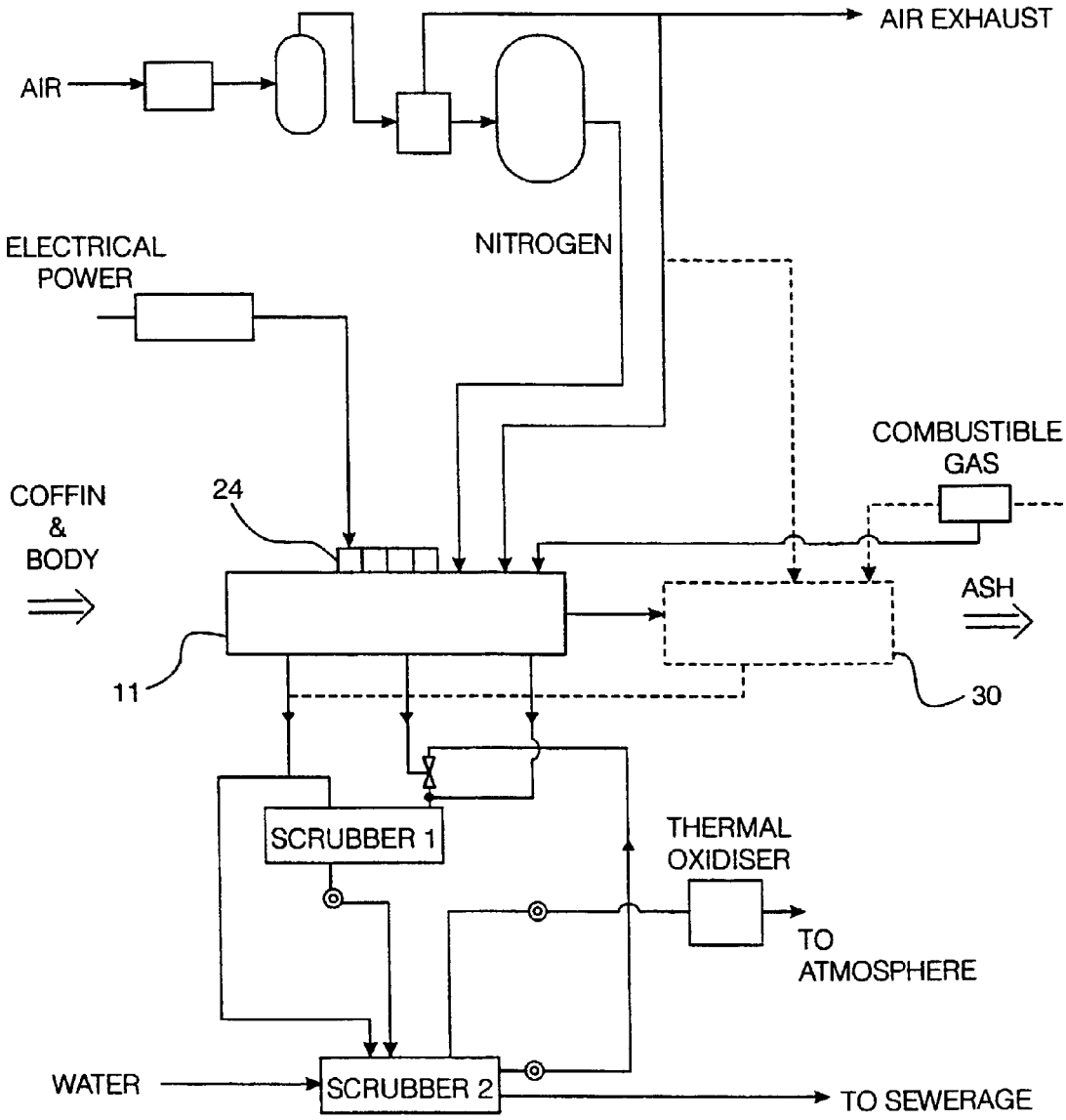
FIG. 2 is a schematic diagram illustrating apparatus for performing the process of the present invention.

The embodiment illustrated in FIG. 2 includes means for generating nitrogen from atmospheric air. The generated nitrogen is introduced into the chamber 11 of FIG. 1 through aperture 27 via a conduit or other pipeline. The introduction of nitrogen into the chamber purges the chamber of air by displacement. The purging gas and atmospheric gas exit the housing through apertures 28 or 29 in roof 23 and proceed to a scrubber 2 before release into the atmosphere or recycling. Combustion and effluent gases also exit the housing through apertures 28 or 29 and proceed to the scrubber 2 via an auxiliary scrubber 1. Before these gases are released into the atmosphere they are recycled through the scrubbers and/or passed through a thermal oxidiser and optionally a catalytic converter (not shown) so as further to reduce the emission of noxious gases such as sulphur dioxide and oxides of nitrogen.

An alternative embodiment of the present invention is shown in the broken outline of FIG. 2. Here the irradiation and combustion steps do not take place in the same chamber. The residue obtained by irradiation of the carbonaceous material are removed from the chamber 12 to a second chamber 31 (indicated by broken lines) where combustion is conducted. The transfer of the residue from the irradiation chamber 12 to the combustion chamber 31 may be mechanical, for example by use of a belt or roller conveyor or slat conveyor. The chambers may be located in the same housing 11 although it will be understood that the scope of the invention includes the possibility that the combustion chamber may have its own housing 30 (as shown).

Figure 3:
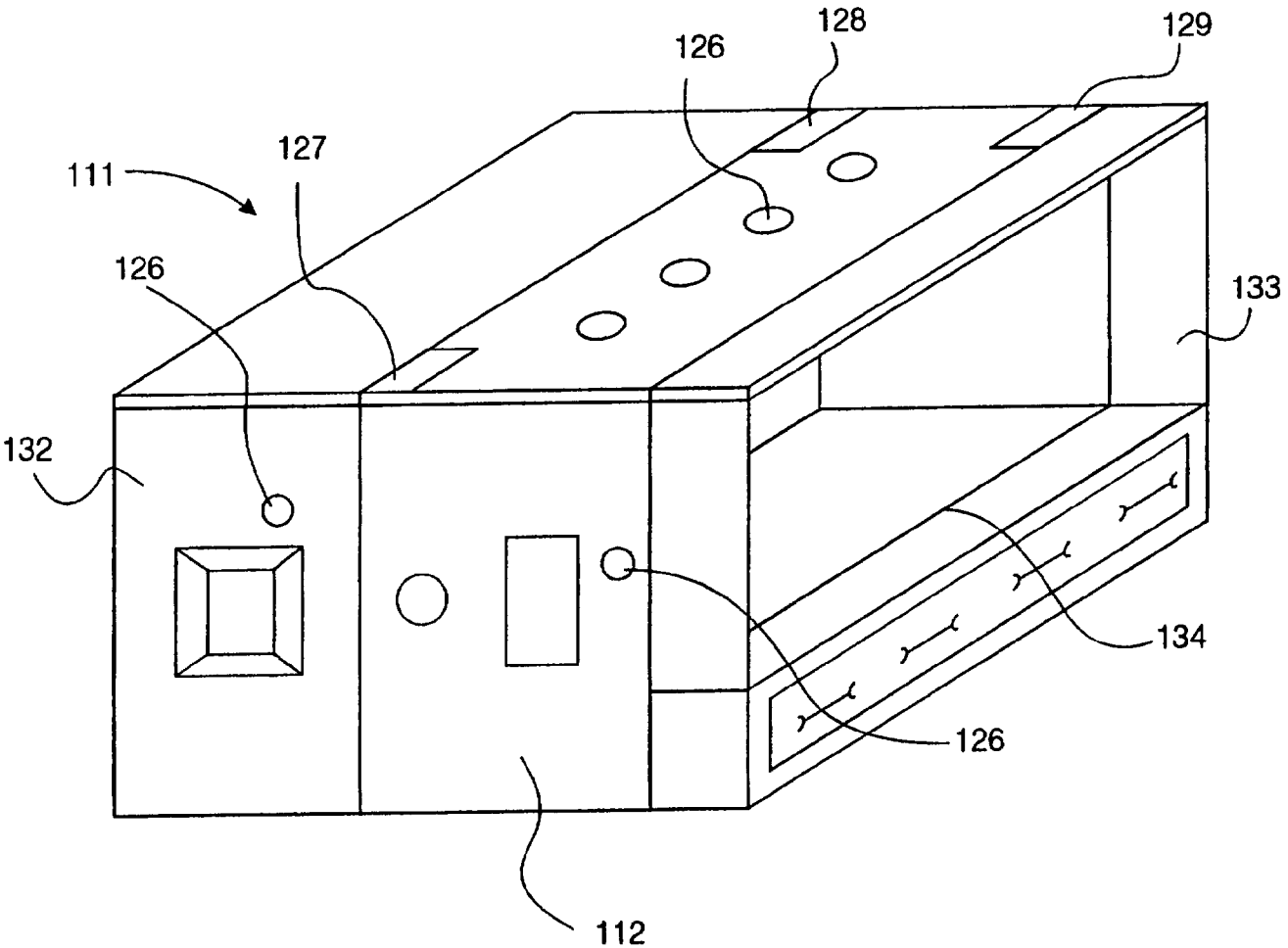
FIG. 3 is an isometric cut-away view of a third embodiment of the present invention.

Referring now to FIG. 3 a further embodiment of the present invention includes a housing 111 having a weighing chamber 132, an irradiation and combustion chamber 112 and an ash collecting chamber 133. The features of the chamber 112 are similar to those previously described except that there is now provided no opening (14) in the front wall for introduction of the coffin and body. Instead weighing chamber 132 is provided with the opening means for introducing the coffin and body 113 into the housing 111. Weighing chamber 132, irradiation and combustion chamber 112 and ash collecting chamber 133 are connected by a lowering partition screen 134 and transfer means that allows lateral transfer of the coffin and body from one chamber to the next. In this embodiment the control dials 120 for controlling the mechanical, electrical or computing machinery are located at the back of the compartment 119 of chamber 111. Ash collecting chamber 133 is shown with partition screen 134 lowered so as to allow collection of ash. The chamber also comprises a cavity such as that provided by a drawer (not shown). The cavity or drawer may contain or be otherwise connected to a cremulator (not shown).

Figure 4:
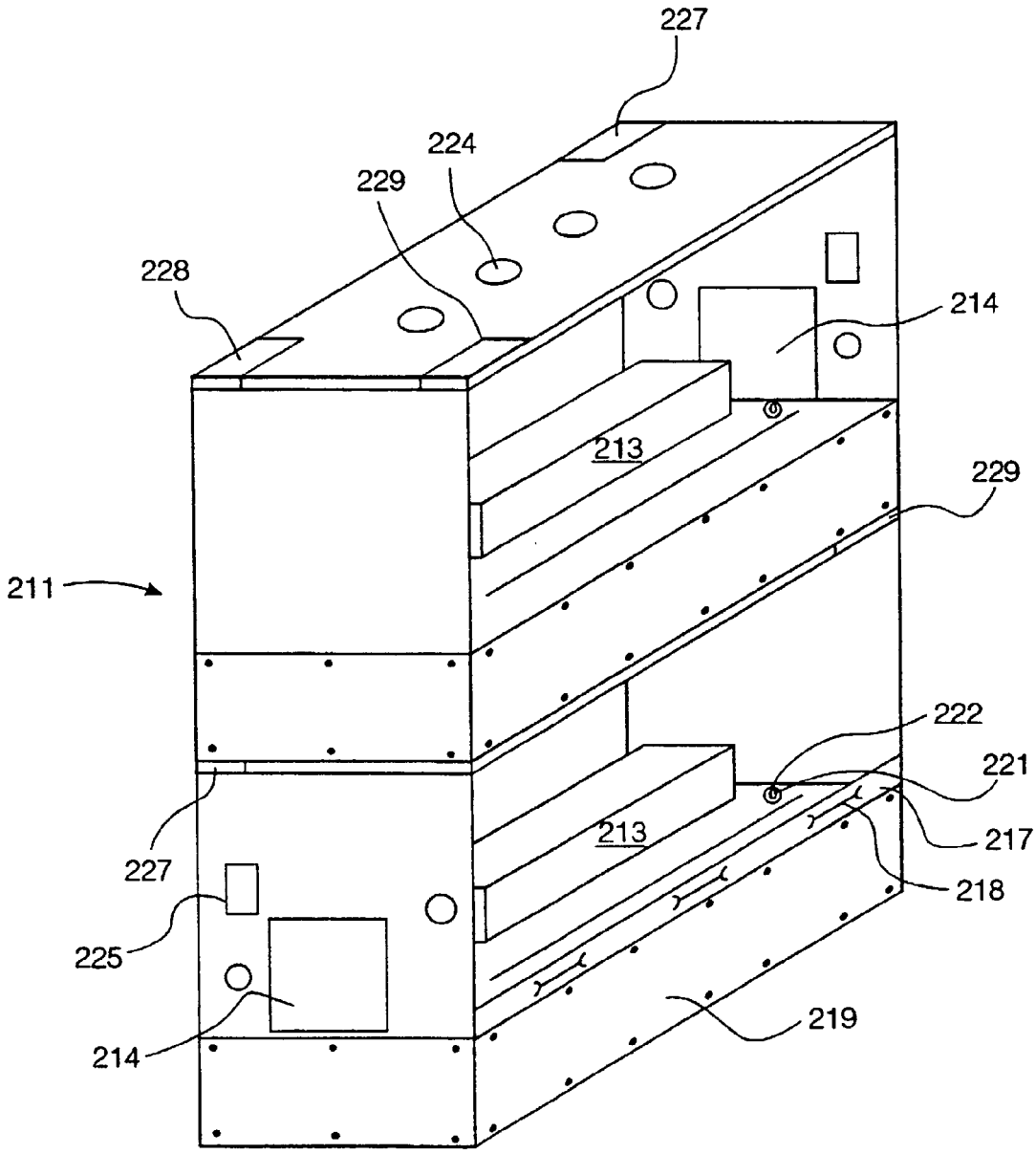
FIG. 4 is an isometric cut-away view illustrating the modularity of the apparatus of the present invention.

Referring now to FIG. 4, there is shown an embodiment of the invention in which two separate housings 211 for single chamber irradiation and combustion are stacked one above the other. The housings 211 are secured by connection means (not shown) and orientated with the openings 214 and doors facing in opposite directions from each other. The dimensions of the housing 211 are typically such that they may be arranged between walls or floors in a building. This embodiment may therefore allow the simultaneous treatment of more than one coffin and body whilst maintaining the separate identity of the treatment products and any gatherings of mourners that may be present. Furthermore such an embodiment allows the economic use of plant such as the machinery for generating nitrogen gas etc.

In another embodiment of the present invention (not shown), in which housings are stacked so as to face the same direction, ash collecting means are not arranged according to removable drawers. Instead each housing is adapted so as to provide a separate chute at or near the back wall of the housing so as to each connect to a dedicated cremulator located at a position on or below the ground. The number of housings that may be stacked upon or adjacent each other is not therefore limited by the need to provide space for removal of drawers or the like.

The housing of the present invention may come in a variety of sizes according to available space or stacking considerations. The materials used for the construction of the housing including microwave protection screens may be any known to the art including GRP and stainless steel. The number of microwave generating transducers 24 in the housing may vary according to the nature of the material to be processed.

A typical process for the treatment of a coffin containing a body according to the embodiment of FIG. 1 of the present invention involves the following steps. The coffin 13 is weighed prior to its introduction into a housing 11. The operator enters the details via the keypad 25 and selects a programme for the treatment process. The chamber 12 is evacuated and then purged by the introduction of nitrogen or oxygen-depleted air. Purging of the chamber 12 is continued whilst microwave irradiation of the coffin 13 is commenced. The effluent gases of the irradiation process (mostly carbon dioxide and water in the form of steam) are carried away by the purging gas. Irradiation is continued according to a calculated time or until the operator, observing through the spy holes 26 intervenes. At the end of the irradiation process a combustible gas and air or oxygen are introduced into the chamber 12 and ignited by operation of ignition means 21 provided in the floor 16 of the chamber. The effluent gases of the combustion process are carried away by the purging gas. The combustion continues according to the pre-selected programme or until such time as is determined by the operator observing through the spy holes 26. After combustion is terminated, the ash is allowed to cool under continued purging of the chamber 12 with nitrogen or oxygen-depleted air. After cooling, the ash is collected by withdrawal of the chamber floor 16 and transferred to a cremulator for final comminution before collection.

The present invention provides a portable housing for use with an apparatus for the safe treatment of human remains. Having described embodiments of the invention with reference to the accompanying drawings, it is to be understood that the invention is not limited to those precise embodiments, and that various changes and modifications may be effected by one skilled in the art without departing from the scope of the invention as defined in the appended claims.

For example depletion of oxygen from chamber 12 may be accomplished by evacuation under reduced pressure before introduction of the nitrogen or oxygen-depleted air. The gangway 15 of chamber floor 16 may have an associated charcoal bed to provide for combustion after irradiation. The coffin may be introduced into the housing by withdrawal and retraction of the chamber floor via the side of the housing. Other modifications to the process and apparatus of the present invention may include recycling the nitrogen gas or oxygen-depleted air and providing a roller conveyor for introducing the coffin 13 into the housing 11 and chamber 12.

Figure 5:
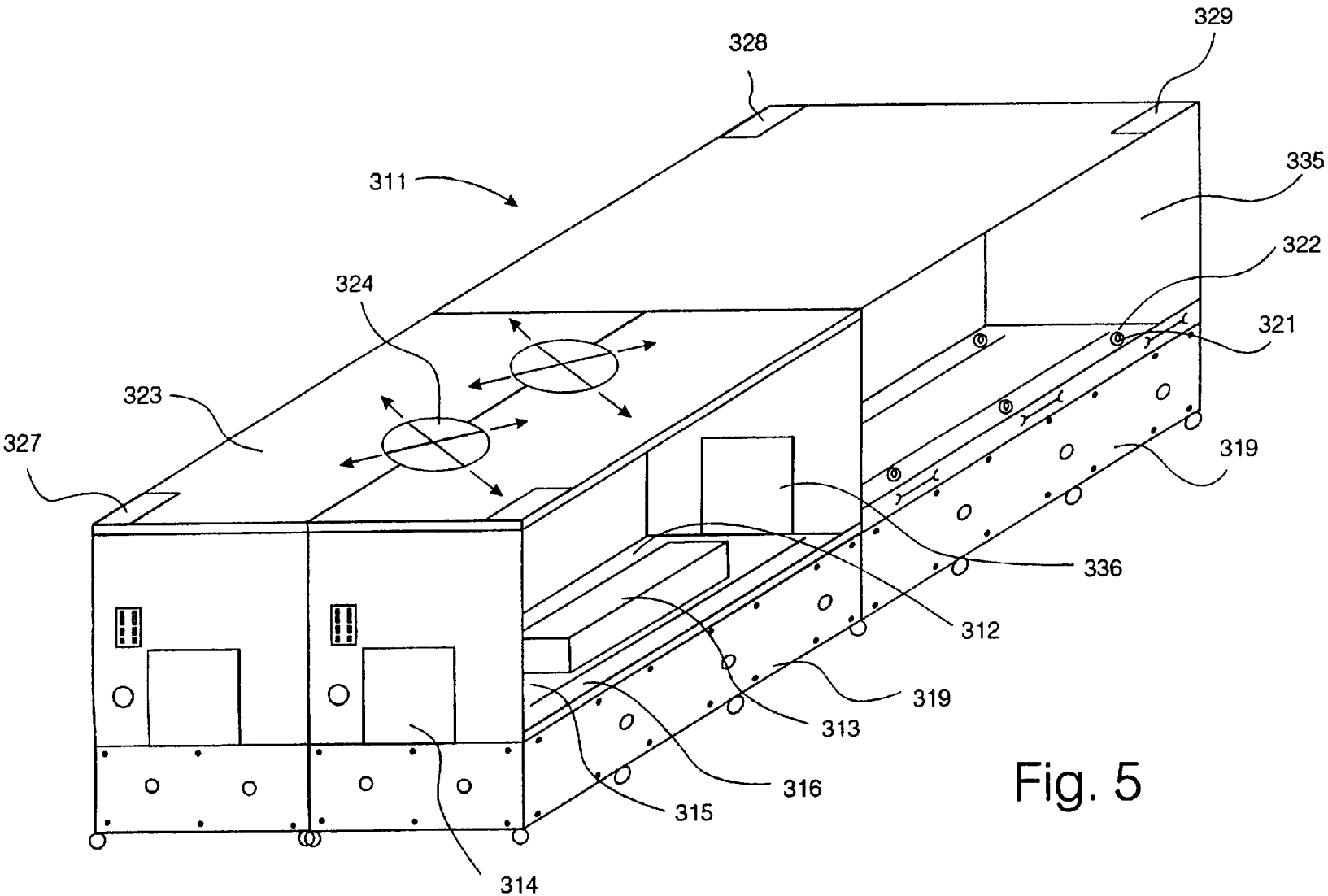
FIG. 5 is an isometric cut-away view of a first embodiment of the invention according to a second aspect.

Referring now to FIG. 5, in which like numerals are employed to describe elements already described in relation to FIGS. 1 to 4, apparatus for performing the process of the present invention comprises a portable housing 311 having two irradiation chambers 312 for receipt of a coffin 313 containing a human body and sharing a common combustion chamber 335. Each chamber 312 has an opening 314 leading onto a gangway 315 formed in or on each chamber floor 316 and which communicates with further openings 336 leading to the common combustion chamber 335. Each opening 314 and 336 is fitted with an automatic, lockable and hermetic sealing door (not shown). The chambers have compartments 319 containing the specific electrical, mechanical and monitoring equipment necessary for the operation of that part of the process associated with its purpose. In addition compartments 319 for each irradiation chamber may be equipped with sliding drawers for temporary storage of the coffin and/or body to be cremated. Cooling means (not shown) are also provided in compartment 319 for each irradiation chamber 312. Combustion chamber 335 has a compartment 319 having ignition means 321 projecting through apertures 322 in the chamber floor 316. The ignition means 321 comprise spark generators and apertures 322 serve for the introduction of a combustible gas or mixture of gases into the chamber 335. Compartment 319 for combustion chamber may also house a cremulator (not shown) and automated means for cooling and delivering ash to a delivery point (not shown) for collection by an operator.

Housing 311 includes a roof panel 323 which can slide in and out of channels defined in the outwardly facing side wall panels of each irradiation chamber. Roof panel 323, includes a centrally disposed array of transducers 324 arranged behind a microwave transparent glass screen (not shown). The transducers 324, which may comprise magnetrons and have water cooling means, are operable so as to direct electromagnetic radiation into one or other chamber 312 or both chambers 312 simultaneously. Roof panel 323 is also equipped with aperture 327, allowing the evacuation of chambers 312 and/or the introduction of an inert gas, such as nitrogen, or oxygen-depleted air.

The process according to one embodiment of the invention involves the following steps: A first coffin and body are introduced into the first irradiation chamber 312, the chamber is evacuated and then purged by introduction of nitrogen or oxygen-depleted air. Purging of the chamber is continued whilst the mechanical opening means is operated and microwave irradiation of the coffin and body is commenced. At the end of the irradiation process the residue is automatically transported to the combustion chamber 335. At this point a second coffin and body are introduced into the second chamber 312 and the evacuation to irradiation steps repeated. At the same time combustible gas and air or oxygen are introduced into the combustion chamber and ignited by operation of ignition means. At the end of incineration of the first residue the ash is cooled, collected for example by vaccum extraction and comminuted before being delivered to a delivery point. The completion of the irradiation of the second body is timed to coincide with the completion of at least the collection of the ashes of the first body. The residue from the second body may then be introduced into the combustion chamber and so on.

In an alternative embodiment the initial step involves combined combustion and electromagnetic irradiation to effect opening of the coffin. Next the chamber is purged of oxygen before an exclusively irradiating step is initiated. Next oxygen is admitted together with a combustible gas before a combustion step is initiated. Finally, oxygen is again purged with the introduction of liquid nitrogen for cooling purposes.

Figure 6:
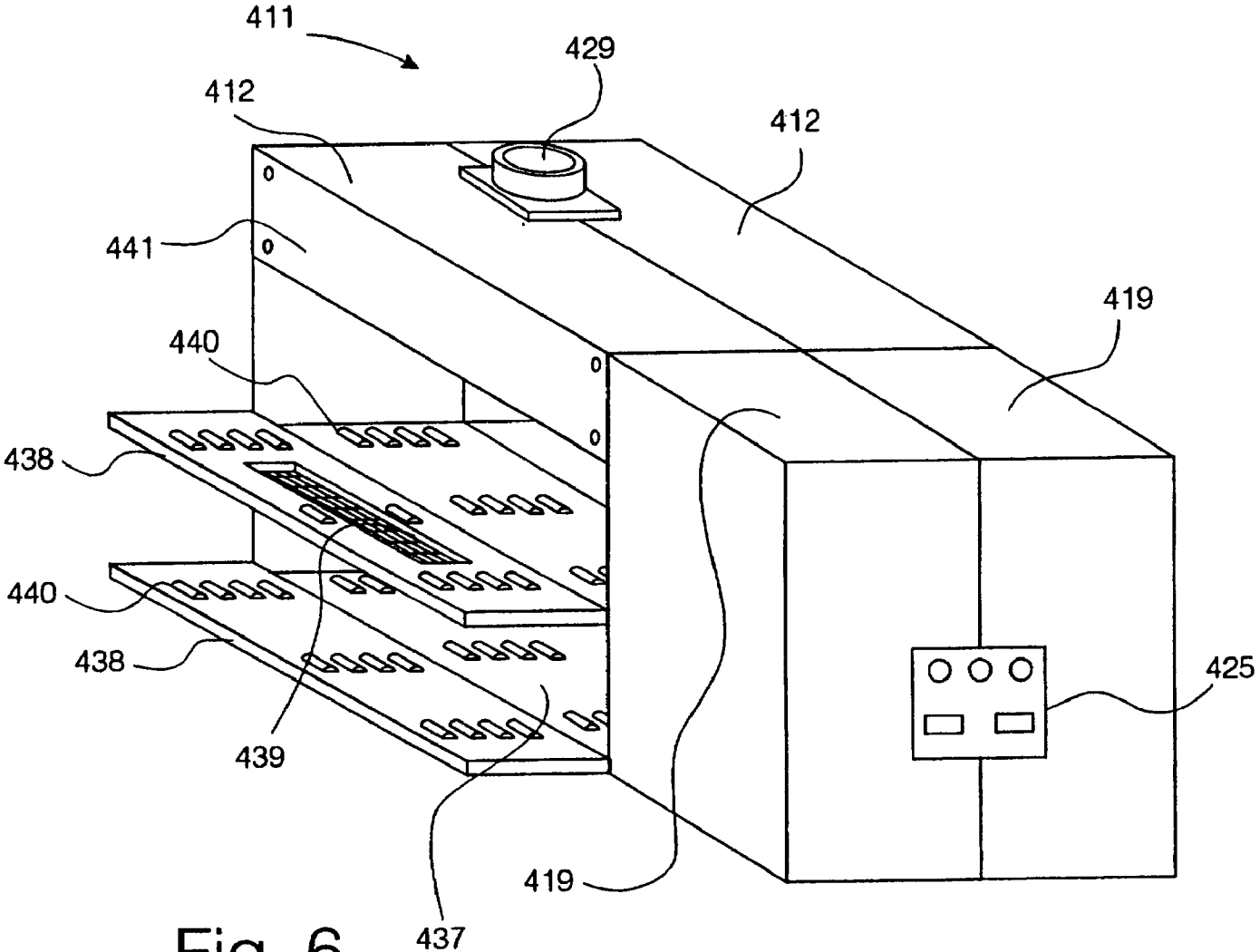
FIG. 6 is an isometric view of a further embodiment of the invention.

Referring now to FIG. 6, another embodiment of the apparatus of the present invention comprises a housing 411 having two single, irradiation and combustion chambers 412 together with equipment compartments 419 arranged at the end of each chamber. The housing further comprises storage chambers 437 arranged directly beneath each irradiation and combustion chamber 412. The compartments 419, which share a control panel 425, contain the specific electrical, mechanical and monitoring equipment necessary for the operation the process of the invention including means for introducing the nitrogen or oxygen-depleted air into each chamber 412, 437. The storage chambers 437, however, will preferably house refrigeration means (not shown) rather than rely on the introduction and exit of a cooling gas.

Chambers 412 and 437 each comprise a fold down door 438 equipped with a handle (not shown). A window 439 formed in the door of the irradiation and combustion chamber allows observation of the process of the invention. Chambers 412 and 437 are provided with rollers 440 so as to aid the introduction of the coffin and body into each chamber. Preferably, a tray (not shown) for the coffin and body is also used since it has the advantage that it ultimately retains ash prior to collection at the end of the incineration step.

The roof section 441 of the housing comprises the roof panel 423 having the centrally disposed, transducer or array of transducers as previously described. In this embodiment of the invention roof panel 423 includes means for generating infra-red radiation so as to initiate the incineration of the ash-like residue in the combustion step of the process. The roof section 441 of the housing is equipped with a centrally disposed exit duct 429 which is common to and operatively linked to each irradiation and combustion chamber 412.

Figure 7:
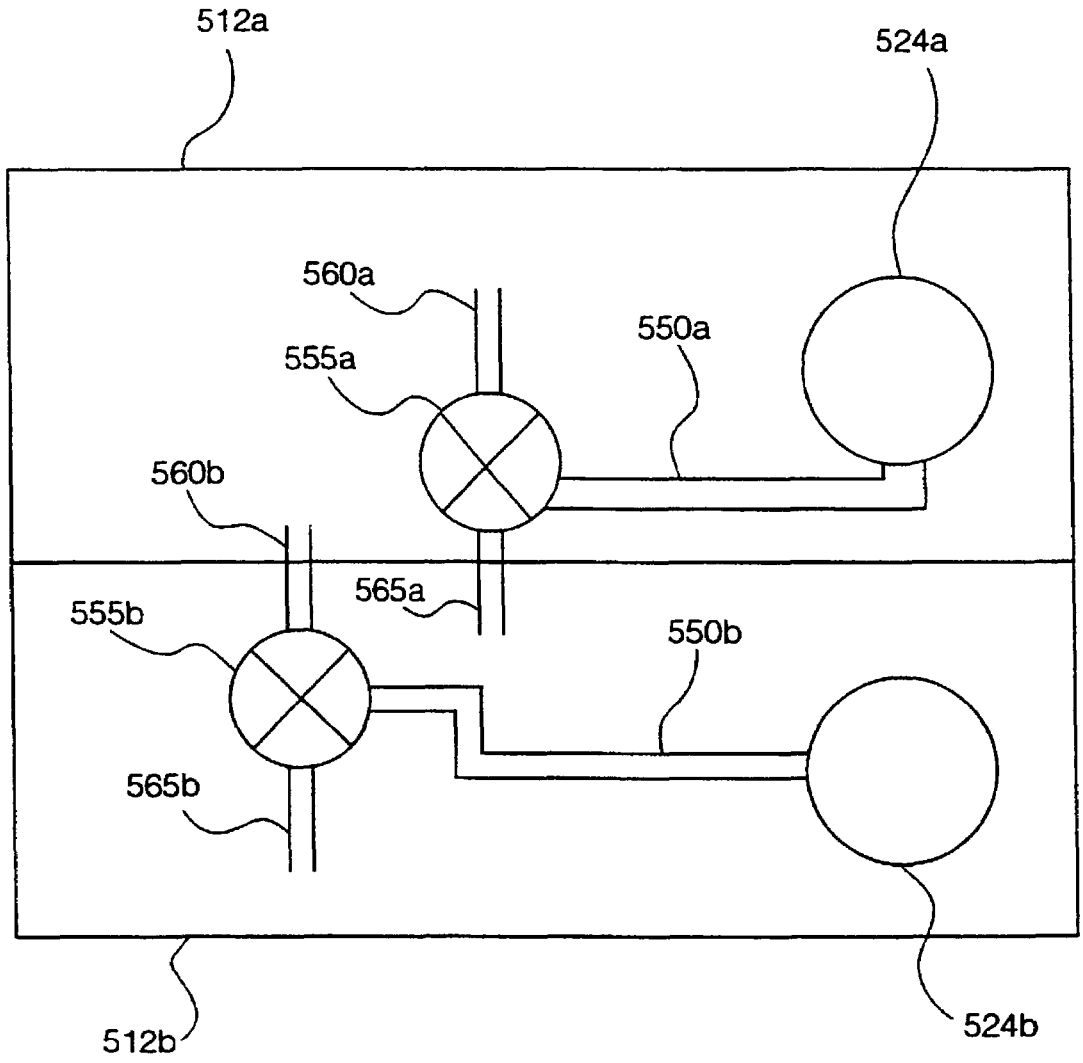
FIG. 7 is a schematic plan view of a still further embodiment of the invention.

The preferred embodiment of the apparatus of the invention has notable advantages over other embodiments in the simplicity of its manufacture and use. In particular it allows easy introduction of the coffin and body into the chamber 412. Further, it allows the operator to collect the cooled ashes by vacuuming them to a suitable receptacle as well as the manual cleaning of the chamber between multiple cremations. As may be expected, the process of the invention may then comprise the irradiation and incineration of a first coffin and body in one chamber 412 whilst the other is unloaded, cleaned and reloaded and so on.

Where more than one chamber is provided there may be provided means for selectively directing the electromagnetic radiation into any chamber; for example by using pivotally mounted magnetrons. Alternatively, as shown in FIG. 7, electromagntic radiation generators 524*a*, 524*b* may selectively provide radiation for one or both of two chambers 512*a*, 512*b* by way of respective wave guides 550*a*, 550*b*. The wave guides may take the form of hollow box-section metal tubes for directing the passage of such radiation, as will be known to those skilled in the art. Switches 555*a*, 555*b* are provided to direct radiation down either or both of two respective branches 560*a*, 560*b*, 565*a*, 565*b* which terminate in respective chambers 512*a*, 512*b*.

Having described embodiments of the invention with reference to the accompanying drawings it is to be understood that the invention is not limited to those precise embodiments and that various changes and modifications may be effected by one skilled in the art without departing from the scope of the invention as defined in the appended claims.

For example, various arrangements are possible for facilitating these steps including conveyor belt and other automated means. Further, it will be apparent that the spatial arrangement of the illustrated embodiments may not be the only ones and that other spatial arrangements, particularly those facilitating the simultaneous use of more than one chapel are possible. In these arrangements communicating means or ducts may also be provided between the various chambers of the apparatus.

What is claimed is:

1. A process for the treatment of carbonaceous material comprising the steps of i) introducing the material, into a chamber having closure means, ii) extracting or displacing oxygen from the chamber so as to provide a substantially oxygen-depleted atmosphere, iii) effecting a preliminary treatment of the material by irradiating with electromagnetic radiation of sufficient power and for a sufficient period to cause substantial degradation of the carbonaceous material to an ash-like residue;

iv) thereafter, introducing oxygen and air and at least one combustible gas into the said chamber, and v) igniting said at least one combustible gas whereby to cause combustion and reduce the residue from the irradiation step to a fine ash.

2. The process of claim 1, in which step v) is performed by removing the residue resulting from step ii) from the said chamber to a second chamber, equipped with means for introducing oxygen or air and the said at least one combustible gas.

3. The process of claim 1, in which ignition of the said at least one combustible gas is initiated by further irradiation with electromagnetic radiation.

4. The process of claim 1, in which step ii) is performed by introducing an inert gas or oxygen-depleted air into the said at least one chamber whereby substantially to fill the said at least one chamber.

5. The process according to claim 4, in which the said inert gas is nitrogen.

6. The process of claim 1, in which step iii) is performed by irradiating the material with microwave radiation.

7. The process of claim 1, including the step of weighing the carbonaceous material to determine the energy level and/or time for irradiation.

8. The process of claim 1, further including the step of cooling the solid products of step v).

9. The process of claim 1, including the further step of collecting the solid products of step v).

10. The process of claim 1, further comprising the step of delivering the said collected products to a delivery point.

11. The process of claim 1, including the further step of pre-heating the said material before step iii).

12. The process of claim 1, in which the gaseous products of steps iii) and/or v) are trapped by chemical reaction or physical transformation.

13. A process for the cremation of the human or animal body comprising the introduction of a body within a coffin into a chamber having closure means, and performing thereon the process of claim 1.

14. The process of claim 13, in which prior to step iii) there is effected a partial opening of the coffin.

15. The process of claim 14, in which the said partial opening is performed by mechanical means.

16. The process of claim 14, in which the said partial opening is performed by heating said coffin and body.

17. Apparatus for the treatment of carbonaceous material comprising a housing defining at least one chamber and having an opening for introducing the material into the said at least one chamber together with closure means for closing the said at least one chamber, the housing also comprising means for extracting or displacing oxygen from the said at least one chamber so as to provide a substantially oxygen-depleted atmosphere in the said at least one chamber, means for irradiating the material in the said at least one chamber with electromagnetic radiation of sufficient power and for a sufficient time so as to cause degradation of the said material to a residue, means for thereafter admitting oxygen or air and at least one combustible gas into the presence of said residue, and means for ignition of the said combustible gas within the said at least one chamber so as to cause substantial combustion and reduce the residue from the irradiation step to a fine ash.

18. The apparatus of claim 17, in which said means for ignition of said at least one combustible gas comprises irradiation with electromagnetic radiation.

19. The apparatus of claim 17, further comprising means for weighing the carbonaceous material prior to, or upon introduction of the said material into the said at least one chamber.

20. The apparatus of claim 17, further comprising means for cooling the solid products of the said combustion.

21. The apparatus of claim 20, in which the said cooling means comprise liquid nitrogen cooling means.

22. The apparatus of claim 17, further comprising means for collection of the said products of combustion.

23. The apparatus of claim 22, further comprising means for the delivery of said products to a delivery point.

24. The apparatus of claim 17, further comprising means for pre-heating the said carbonaceous material.

25. The apparatus of claim 17, in which the said means for extracting or displacing oxygen from said at least one chamber comprise means for introducing a substantially inert gas or oxygen-depleted air whereby to substantially fill the said at least one chamber.

26. The apparatus of claim 25, in which said inert gas is nitrogen.

27. The apparatus of claim 17, further comprising means for trapping the gaseous products of said combustion.

28. The apparatus of claim 17, in which the said at least one chamber is formed in a portable housing, said housing having means for connection to an external energy source.

29. The apparatus of claim 17 adapted for the cremation of bodily remains.

30. The apparatus of claim 29, in which the said opening allows introduction of said bodily remains within a coffin, and in which there are provided means for effecting at least partial opening of the said coffin.

31. The apparatus of claim 29, in which said means for effecting the said at least partial opening of the coffin comprise or include means for heating the said coffin and body.

32. The apparatus of claim 29 further comprising means for storage of said human body and/or said coffin.

33. The apparatus of claim 32 in which said storage means comprise refrigeration means.

34. The apparatus of claim 33 in which said refrigeration means comprise liquid nitrogen refrigeration means.

35. The apparatus of claim 17, in which the irradiating means comprise a single transducer or array of transducers whereby electromagnetic radiation is selectively directed into said at least one chamber.

* * * * *